US010702020B2

(12) United States Patent
Chen et al.

(10) Patent No.: US 10,702,020 B2
(45) Date of Patent: Jul. 7, 2020

(54) SHOE WITH SPIKES

(71) Applicants: Benjamin Chen, Kaohsiung (TW); Ethan Chen, Kaohsiung (TW)

(72) Inventors: Benjamin Chen, Kaohsiung (TW); Ethan Chen, Kaohsiung (TW)

( * ) Notice: Subject to any disclaimer, the term of this patent is extended or adjusted under 35 U.S.C. 154(b) by 45 days.

(21) Appl. No.: 15/943,004

(22) Filed: Apr. 2, 2018

(65) Prior Publication Data

US 2019/0298002 A1 Oct. 3, 2019

(51) Int. Cl.

| | |
|---|---|
| ***A43C 15/14*** | (2006.01) |
| ***A43C 15/06*** | (2006.01) |
| ***A43B 3/24*** | (2006.01) |
| ***A43B 13/26*** | (2006.01) |
| *A43B 13/12* | (2006.01) |
| *A43B 5/00* | (2006.01) |
| *A43B 13/18* | (2006.01) |
| *A43B 5/04* | (2006.01) |
| *A43B 13/24* | (2006.01) |
| *A43B 13/28* | (2006.01) |
| *A43B 13/36* | (2006.01) |
| *A43C 15/12* | (2006.01) |
| *A43B 13/30* | (2006.01) |
| *A43B 13/22* | (2006.01) |

(52) U.S. Cl.

CPC ..... *A43C 15/14* (2013.01); *A43B 3/246* (2013.01); *A43B 13/26* (2013.01); *A43C 15/061* (2013.01); *A43B 5/001* (2013.01); *A43B 5/0415* (2013.01); *A43B 5/0417* (2013.01); *A43B 13/122* (2013.01); *A43B 13/184* (2013.01); *A43B 13/22* (2013.01); *A43B 13/24* (2013.01); *A43B 13/28* (2013.01); *A43B 13/30* (2013.01); *A43B 13/36* (2013.01); *A43C 15/12* (2013.01)

(58) Field of Classification Search

CPC ..... A43C 15/14; A43C 15/061; A43C 15/12; A43B 3/246; A43B 13/26; A43B 13/122; A43B 13/184; A43B 13/24; A43B 13/22; A43B 13/28; A43B 13/30; A43B 13/36; A43B 5/001; A43B 5/0415; A43B 5/0417

USPC ..... 36/103, 124, 127, 134

See application file for complete search history.

(56) References Cited

U.S. PATENT DOCUMENTS 3,693,271 A * 9/1972 Korpei ..... A43C 15/14 36/61

3,755,929 A * 9/1973 Frisch ..... A43B 5/18 36/7.6

(Continued)

*Primary Examiner* — Alissa J Tompkins
*Assistant Examiner* — Dakota Marin
(74) *Attorney, Agent, or Firm* — Rosenberg, Klein & Lee

(57) ABSTRACT

A shoe with spikes is disclosed. The shoe includes an accommodation seat, at least one moving plate, a transmission module, a plurality of posts, a plurality of spikes, and a shoe plate. The accommodation seat includes a chamber. The moving plate is disposed in the chamber and controlled to move between a first position and a second position, and includes a plurality of push members. The transmission module is configured to move the moving plate. The posts extend from the accommodation seat toward the ground. The spikes are fixed to the posts and extend out of the chamber. When the moving plate is in the first position, the spikes protrude out of the shoe plate relative to the ground. When the moving plate is moved to the second position, the push members push the shoe plate, and the spikes do not protrude out of the shoe plate.

8 Claims, 10 Drawing Sheets

(56) References Cited

U.S. PATENT DOCUMENTS

| | | | | | |
|---|---|---|---|---|---|
| 3,793,751 | A * | 2/1974 | Gordos | A43C 15/14 | 36/61 |
| 4,454,664 | A * | 6/1984 | MacNeil | A43C 15/161 | 36/114 |
| 5,243,776 | A * | 9/1993 | Zelinko | A43B 3/0042 | 36/127 |
| 5,269,080 | A * | 12/1993 | Davis | A43C 15/14 | 36/114 |
| 5,497,565 | A * | 3/1996 | Balgin | A43C 15/14 | 36/134 |
| 5,557,865 | A * | 9/1996 | Sjosvard | A43C 15/14 | 36/134 |
| 5,737,855 | A * | 4/1998 | Jordan | A43B 5/001 | 36/134 |
| 5,836,092 | A * | 11/1998 | Yarnell | A43C 15/14 | 36/61 |
| 5,870,838 | A * | 2/1999 | Khayat | A43C 15/14 | 36/134 |
| 6,125,556 | A * | 10/2000 | Peckler | A43B 5/001 | 36/127 |
| 7,490,418 | B2 * | 2/2009 | Obeydani | A43C 15/14 | 36/61 |
| 7,926,205 | B2 * | 4/2011 | Åmark | A43C 15/14 | 36/127 |
| 8,347,527 | B2 * | 1/2013 | Thielen | A43C 15/14 | 36/134 |
| 8,510,973 | B2 * | 8/2013 | Bachmann | A43C 15/14 | 36/127 |
| 9,913,512 | B2 * | 3/2018 | Bachmann | A43B 3/0042 | |
| 2005/0198867 | A1 * | 9/2005 | Labbe | A43B 11/00 | 36/50.1 |

* cited by examiner

SHOE WITH SPIKES

FIELD OF THE INVENTION

The present invention relates to a shoe with spikes, and more particularly to a shoe with spikes which can be controlled to be exposed or retracted so that the wearer can go in and out of the room without the need to change shoes or put on/take off shoe covers.

BACKGROUND OF THE INVENTION

In general, the soles of each pair of shoes have a non-slip design that allows the wearer to walk stably and safely. However, when the wearer walks in the snow or on icy roads, this non-slip effect of the soles is not enough. It is necessary to wear snow boots having a cleat design, or the shoes are fitted with shoe covers having spikes to increase the grip and friction between the sole and the ground.

However, when the wearer goes back indoors, the soles having spikes are prone to damage the floor. Therefore, the wearer needs to take off the snow boots or the shoe covers before entering the house. It is quite inconvenient for the wearer to change shoes or put on/take off shoe covers.

U.S. Pat. No. 7,926,205, titled "SOLE ARRANGEMENT AND SHOE", discloses shoes with retractable spikes. A shoe 2 comprises a sole arrangement 4. The sole arrangement 4 is characterized in that it comprises an upper sole member 20, a locking sole member 30, and a lower sole member 50. The spikes 1 are accommodated in the sole arrangement 4. In this invention, by pulling the locking sole member 30, the lower sole member 50 is movably attached to the upper sole member 20, allowing the lower sole member 50 to move in a vertical direction relative to the upper sole member 20. The spikes 21 are moveable relative to the lower sole member 50.

Although in this invention the spikes 21 can be controlled to freely protrude out and retract in the bottom of the shoe 2 to improve the convenience of use, the displacement of the locking sole member 30 may be different because the force applied by each person is different during operation. It is inconvenient to move the locking sole member 30 back to the original position. Accordingly, the inventor of the present invention has devoted himself based on his many years of practical experiences to solve these problems.

SUMMARY OF THE INVENTION

The primary object of the present invention is to provide a shoe with spikes. The spikes can be easily controlled to protrude outwardly or retract inwardly.

In order to achieve the aforesaid object, the shoe of the present invention comprises a shoe body, an accommodation seat, at least one moving plate, an operation member, a transmission module, at least one spring, a plurality of posts, a plurality of spikes, and a shoe plate.

The shoe body includes a bottom surface relative to the ground. The accommodation seat includes a bottom wall attached to the bottom surface, a surrounding wall extending from the bottom wall toward the ground, and a chamber defined by the bottom wall and the surrounding wall. The at least one moving plate is disposed in the chamber and controlled to move between a first position and a second position. The at least one moving plate includes a plurality of push members. The operation member is inserted through the surrounding wall. The transmission module is disposed in the chamber. The transmission module includes an operation gear connected with the operation member and at least one moving unit corresponding to the at least one moving plate. The at least one moving unit includes a control gear meshing with the operation gear and a cam connected to an axle of the control gear. The cam is rotated to touch and move the at least one moving plate. The at least one spring is connected to the at least one moving plate. Each of the posts has a first end fixed to the bottom wall and a second end extending from the bottom wall toward the ground. The spikes are fixed to the second ends of the posts respectively and extend out of the chamber. The shoe plate includes a shoe plate body, a push surface formed on the shoe plate body, a plurality of upright through holes formed in the shoe plate body, and a plurality of grooves formed on the push surface. The posts are inserted through the upright through holes, respectively. The shoe plate is movably disposed in the accommodation seat.

When the operation member is moved, the operation member drives the operation gear to rotate, and the operation gear rotates the control gear of the at least one moving unit, and the control gear rotates the cam and controls whether an extension portion of the cam is to push and lean against the at least one moving plate. When the extension portion of the cam is rotated to lean against the at least one moving plate, the at least one moving plate is secured in one of the first position and the second position, and the spring is deformed. When the extension portion of the cam is rotated not to lean against the at least one moving plate, the at least one spring generates a horizontal restoring force to move the at least one moving plate back to one of the first position and the second position.

When the at least one moving plate is in the first position, the shoe plate body is in a retracted position and the spikes protrude out of the shoe plate body relative to the ground, and the push members are accommodated in the grooves, respectively. When the at least one moving plate is moved from the first position to the second position, the push members push the shoe plate body and are moved out of the grooves and lean against the push surface so that the shoe plate body is moved toward the ground to an extended position, and the spikes are accommodated in the upright through holes respectively and do not protrude out of the shoe plate body relative to the ground.

Preferably, the shoe further comprises at least one return spring. The at least one return spring has an inner diameter for insertion of a corresponding one of the posts. The at least one return spring is located between the shoe plate body and a corresponding one of the spikes. When the at least one moving plate is moved from the first position to the second position, the shoe plate body is pushed from the retracted position to the extension portion to compress the at least one return spring, the at least one return spring is deformed, the at least one return spring is stopped by the corresponding spike and will not separate from the corresponding post, and the spikes are accommodated in the upright through holes, respectively. When the at least one moving plate is moved from the second position to the first position, the shoe plate is not pushed and stops compressing the at least one return spring, and the at least one return spring generates a vertical restoring force to push the shoe plate body back to the retracted position.

Preferably, the moving plate is plural. The spring is connected between any two of the moving plates. The moving plate is connected with the spring.

Preferably, the moving plate and the spring are singular. One end of the spring is connected to the moving plate, and another end of the spring is connected to one of the surrounding wall and the bottom wall.

Preferably, the moving plate and the spring are plural. The moving plate corresponds to the spring. One end of the spring is connected to the moving plate, and another end of the spring is connected to one of the surrounding wall and the bottom wall.

Preferably, the shoe plate further includes a plurality of first inner peripheral surfaces, a plurality of second inner peripheral surfaces, a plurality of shoulder surfaces connected with the first inner peripheral surfaces and the second inner peripheral surfaces, respectively. Each of the upright through holes includes a small hole portion surrounded by a corresponding one of the first inner peripheral surfaces and a large hole portion surrounded by a corresponding one of the second inner peripheral surfaces.

Preferably, each of the push members has an inclined surface for pushing the shoe plate body from the first position to the second position.

Preferably, the moving plate includes a plate body, a plurality of track holes formed in the plate body for insertion of the posts. When the plate body is moved, the track holes are moved relative to the posts respectively so that the posts are kept to be inserted through the track holes respectively.

According to the above technical features, the following effects can be achieved:

1. By driving the operation member to cooperate with the transmission module and the spring, the moving plates can be moved horizontally to push the shoe plate in cooperation with the return springs to generate vertical restoring forces for the shoe plate to be moved vertically, so that the spikes can protrude out of the shoe plate or retract to be accommodated in the upright through holes. Therefore, the user can freely control the spikes to be exposed or retracted, and the operation is convenient to improve the ease of use.

DETAILED DESCRIPTION OF THE PREFERRED EMBODIMENTS

Embodiments of the present invention will now be described, by way of example only, with reference to the accompanying drawings.

Figure 1:
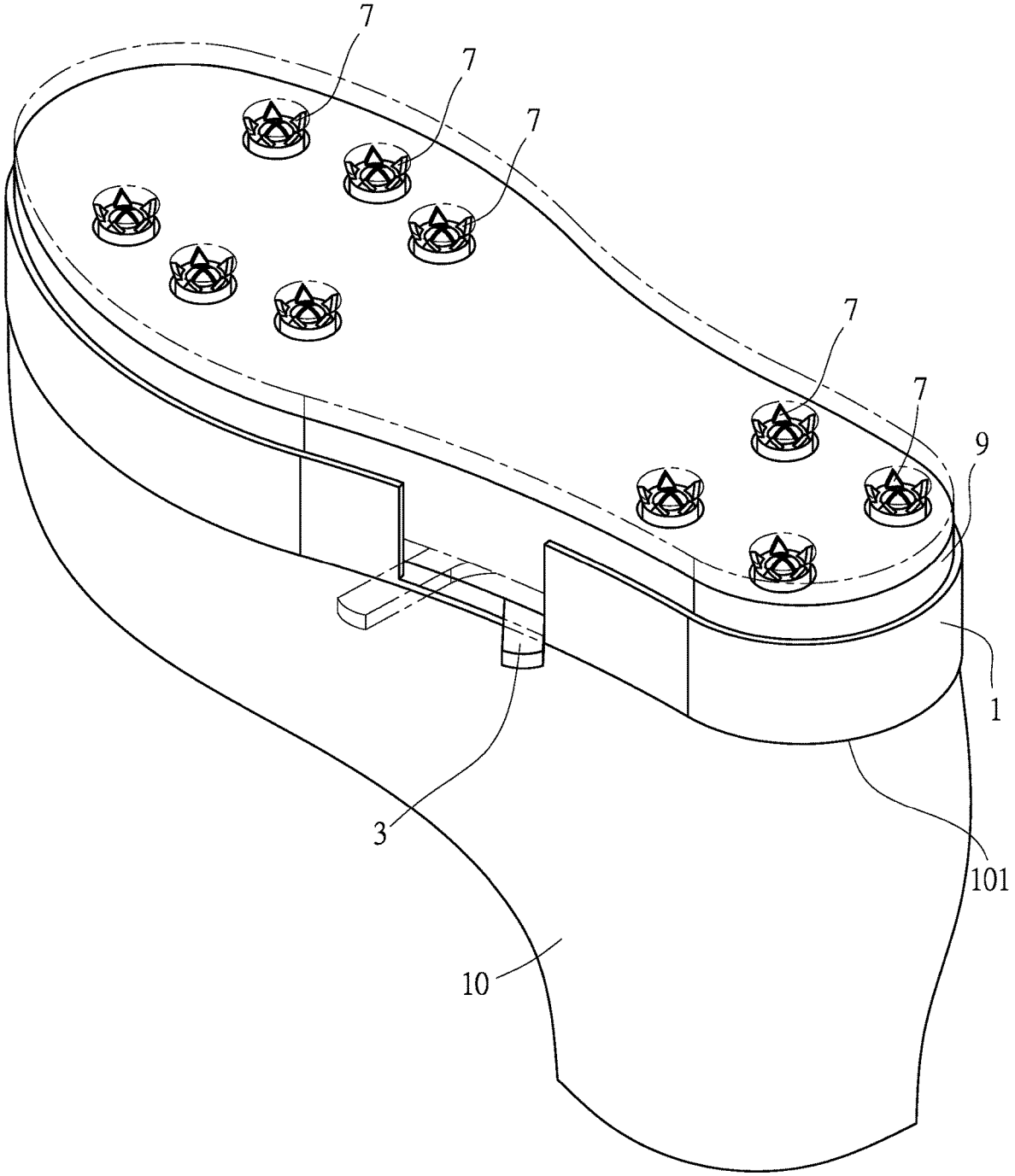
FIG. 1 is a perspective view, illustrating a shoe with spikes in accordance with a first embodiment of the present invention.
Figure 2:
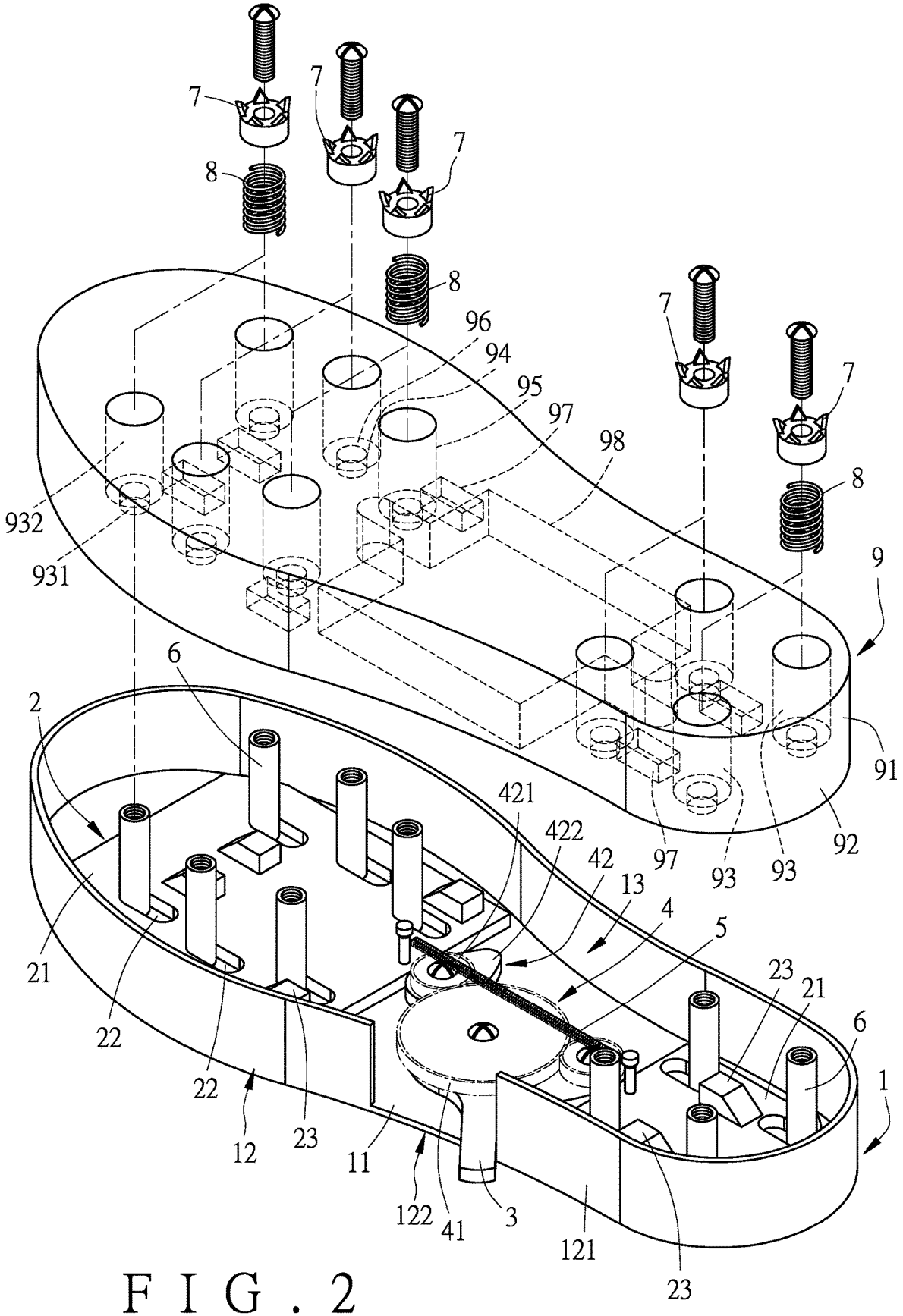
FIG. 2 is an exploded view, illustrating the internal structure in accordance with the first embodiment of the present invention.
Figure 3:
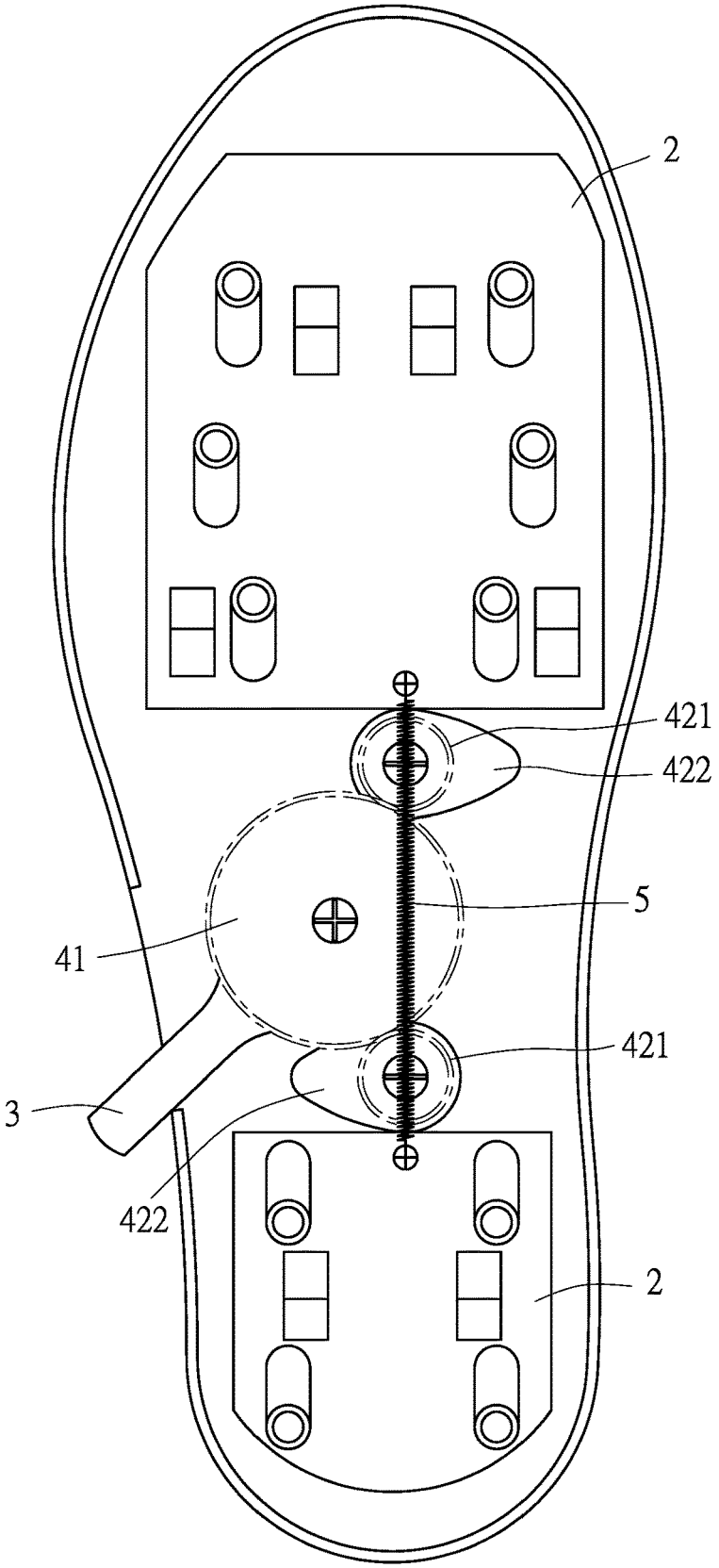
FIG. 3 is a partial top view, illustrating two moving plates located in a first position in accordance with the first embodiment of the present invention.
Figure 4:
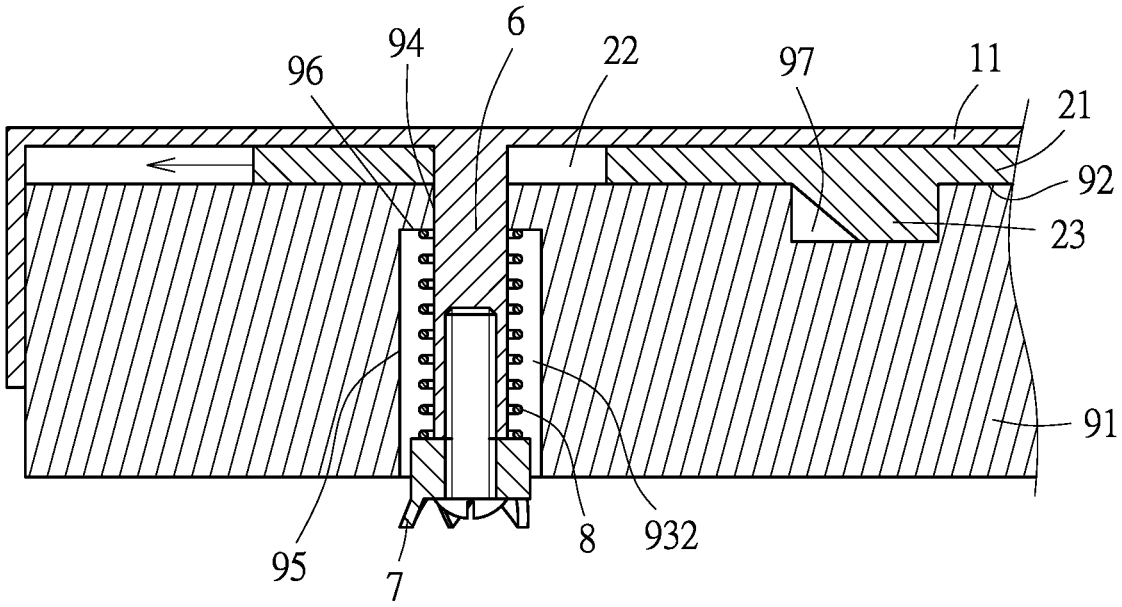
FIG. 4 is a partial sectional view, illustrating a shoe plate located in a retracted position in accordance with the first embodiment of the present invention.
Figure 5:
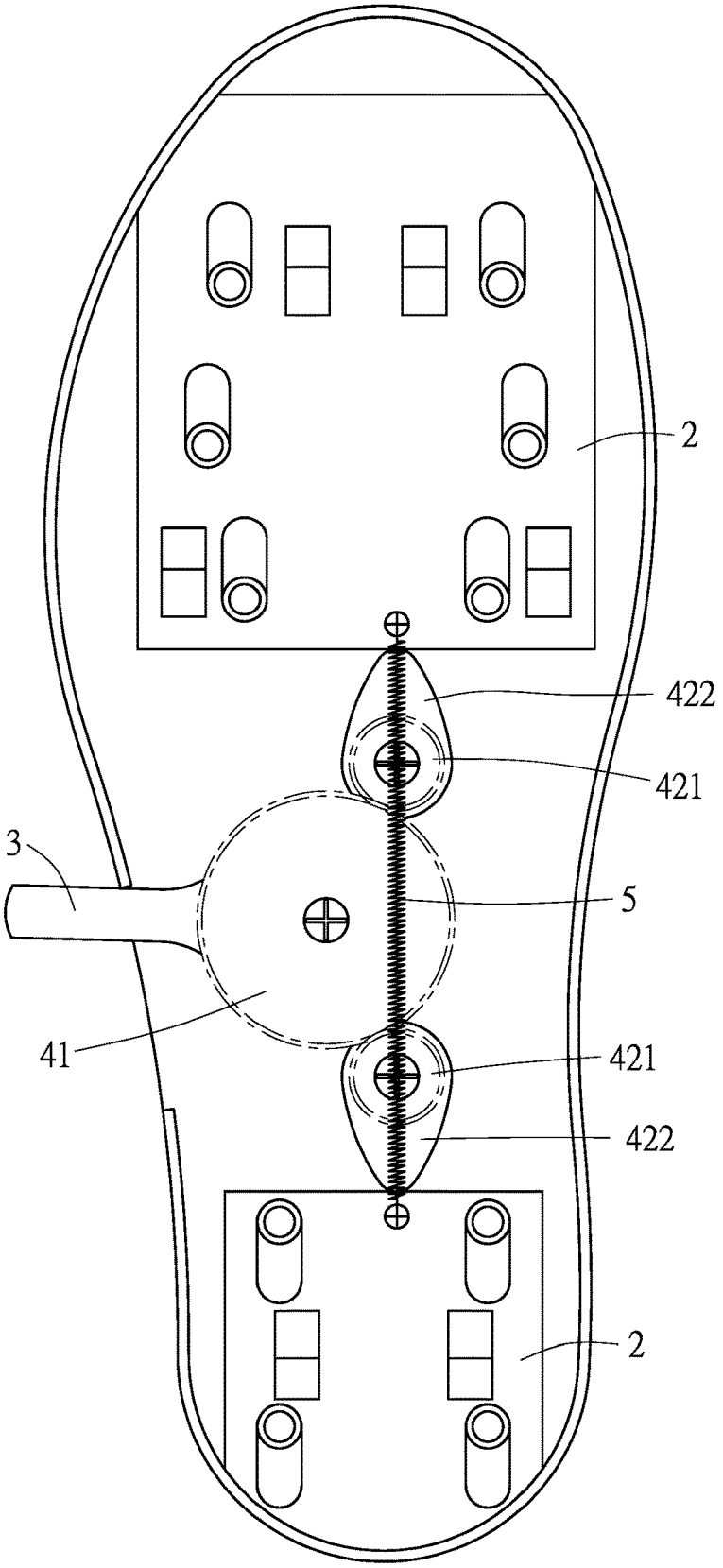
FIG. 5 is a partial top view, illustrating the moving plates located in a second position in accordance with the first embodiment of the present invention.
Figure 6:
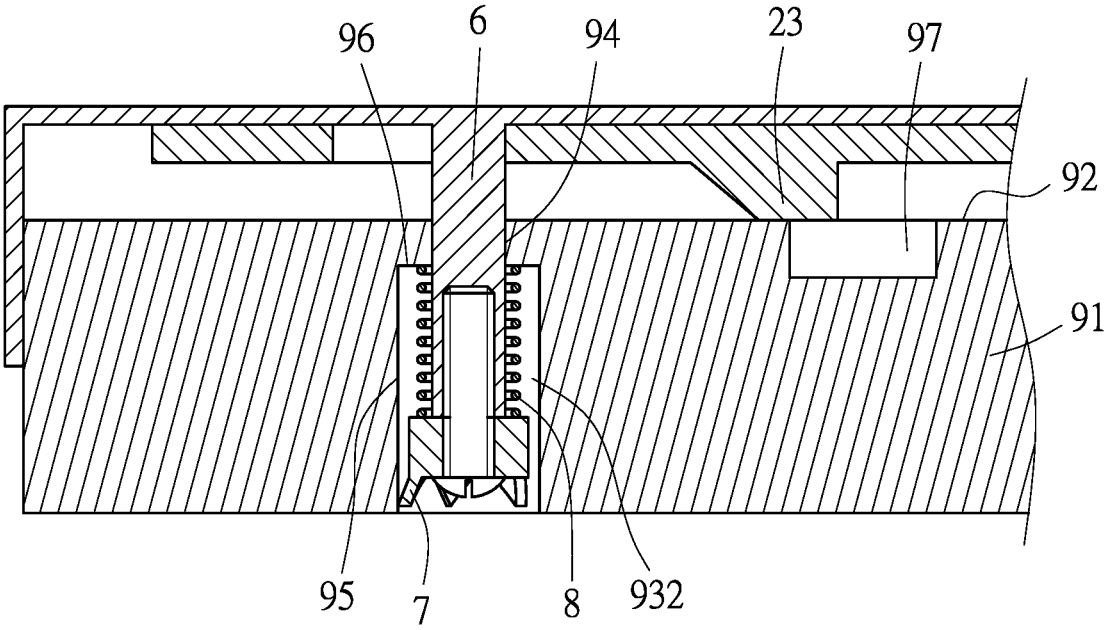
FIG. 6 is a partial sectional view, illustrating the shoe plate located in an extended position in accordance with the first embodiment of the present invention.

Referring to FIG. 1 and FIG. 2, a shoe with spikes according to a first embodiment of the present invention comprises a shoe body 10, an accommodation seat 1, a plurality of moving plates 2, an operation member 3, a transmission module 4, a spring 5, a plurality of posts 6, a plurality of spikes 7, a plurality of return springs 8, and a shoe plate 9.

The shoe body 10 may be any form of shoes, such as boots, sports shoes, leather shoes, etc. In this embodiment, the shoe body 10 is a boot. The shoe body 10 includes a bottom surface 101 relative to the ground.

The accommodation seat 1 includes a bottom wall 11 attached to the bottom surface 101, a surrounding wall 12 extending from the bottom wall 11 toward the ground, and a chamber 13 defined by the bottom wall 11 and the surrounding wall 12. Wherein, the surrounding wall 12 includes a wall body 121 and a through hole 122 formed on the wall body 121.

The moving plates 2 are disposed in the chamber 13 and can be controlled to move horizontally between a first position and a second position. In this embodiment, the number of the moving plates 2 is two. Each moving plate 2 includes a plate body 21, a plurality of track holes 22, and a plurality of push members 23. The track holes 22 are formed in the plate body 21, respectively. The push members 23 are disposed on the plate body 21. Each push member 23 has a rectangular shape. One side of the push member 23 is inclined.

The operation member 3 is inserted through the through hole 122 of the surrounding wall 12, and is manually operated by a user to move horizontally between an operation retracted position and an operation extended position.

The transmission module 4 is disposed in the chamber 13, and includes an operation gear 41 connected with the operation member 3 and a plurality of moving units 42 corresponding to the moving plates 2 respectively. Each moving unit 42 includes a control gear 421 meshing with the operation gear 41 and a cam 422 rotatably connected to the axle of the control gear 421.

The spring 5 is disposed in the chamber 13 and connected between the moving plates 2. The number of the springs 5 may be plural. For example, if the number of the moving plates 2 is three, the number of the springs 5 is two or more. Each spring 5 is connected between every two of the movables plates 2. Each mobile plate 2 is connected with at least one spring 5.

Each of the posts 6 has a first end fixed to the bottom wall 11 and a second end extending from the bottom wall 11 toward the ground. In this embodiment, the posts 6 are inserted through the track holes 22 from the bottom wall 11 and extend toward the ground, respectively. When the moving plates 2 are moved, the track holes 22 are moved relative to the posts 6 respectively so that the posts 6 are kept to be inserted through the track holes 22, respectively. It should be noted that if the position of the posts 6 disposed on the bottom wall 11 is not overlapped with the moving plates 2, the posts 6 do not need to be inserted through the track holes 22.

The spikes 7 are fixed to the second ends of the posts 6, respectively. The spikes 7 extend out of the chamber 13.

The inner diameters of the return springs 8 are adapted for insertion of the corresponding the posts 6, respectively. The return springs 8 are located between the shoe plate 9 and the corresponding spikes 7, respectively. The outer diameters of the return springs 8 are less than the corresponding spikes 7, respectively. Therefore, when the return springs 8 apply a force towards the corresponding spikes 7, the return springs 8 are stopped by the corresponding spikes 7 and will not separate from the corresponding posts 6. In this embodiment, the number of the return springs 8 is six for insertion of six posts 6.

The shoe plate 9 includes a shoe plate body 91, a push surface 92 formed on the shoe plate body 91, a plurality of upright through holes 93 formed in the shoe plate body 91, a plurality of first inner peripheral surfaces 94, a plurality of second inner peripheral surfaces 95, a plurality of shoulder surfaces 96 connected with the first inner peripheral surfaces 94 and the second inner peripheral surfaces 95 respectively, a plurality of grooves 97 formed on the push surface 92, and a recess 98 formed on the push surface 92. Each of the upright through holes 93 includes a small hole portion 931 surrounded by a corresponding one of the first inner peripheral surfaces 94 and a large hole portion 932 surrounded by a corresponding one of the second inner peripheral surfaces 95. In this embodiment, the upright through hole 93 is a stepped through hole.

The posts 6 are inserted through the upright through holes 93, respectively. The shoe plate 9 is movably disposed in the accommodation seat 1. The return springs 8 are inserted in the large holes 932 and in contact with the shoulder surfaces 96, respectively. The shoe plate body 91 is attached to the moving plates 2. The push members 23 are accommodated in the grooves 97, respectively. The transmission module 4 and the spring 5 are accommodated in the recess 98.

Referring to FIG. 3 to FIG. 6, when the operation member 3 is in the operation retracted position, the moving plates 2 are located in the first position, respectively. The extension portions of the cams 422 do not touch the moving plates 2. The spring 5 is in an unstressed state. The shoe plate body 91 is located in a retracted position. The spikes 7 protrude out of the shoe plate body 91 relative to the ground. The push members 23 are accommodated in the grooves 97, respectively. The return springs 8 are in an unstressed state.

When the operation member 3 is moved from the operation retracted position to the operation extended position, the operation member 3 drives the operation gear 41 to rotate, and the operation gear 41 rotates the control gears 421, and the control gears 421 respectively drive the cams 422 to rotate, so that the extension portions of the cams 422 push and lean against the moving plates 2, and the moving plates 2 are moved from the first position to the second position and kept in the second position. At the same time, the spring 5 is deformed, and the push members 23 respectively push the shoe plate body 91. Because each push member 23 has an inclined surface for pushing the shoe plate body 91 from the first position to the second position, the shoe plate body 91 is moved along the inclined surfaces of the push members 23 toward the ground to an extended position. The push members 23 are moved out of the grooves 97 and pressed against the push surface 92, respectively. In this case, in a balanced state, the shoulder surfaces 96 of the shoe plate 9 press the return springs 8 respectively so that the return springs 8 are deformed, and the spikes 7 are accommodated in the large hole portions 932 of the upright through holes 93 respectively, and the spikes 7 do not protrude out of the shoe plate body 91 relative to the ground.

Then, when the operation member 3 is moved from the operation extended position to the operation retracted position, the operation member 3 drives the operation gear 41 to rotate again. Similarly, the operation gear 41 rotates the control gears 421, and then the control gears 421 drive the cams 422 to rotate respectively, so that the extension portions of the cams 422 are returned to the state that does not abut against the moving plates 2. The spring 5 generates a horizontal restoring force to move the moving plates 2 back to the first position, respectively. The push members 23 are moved close to the corresponding grooves 97 and no longer abut against the push surface 92. The shoe plate body 91 is not pushed, and the shoulder surfaces 96 stop compressing the return springs 8. The return springs 8 generate a plurality of corresponding vertical restoring forces to push the shoe plate body 91 back to the retracted position, and the push members 23 are accommodated in the grooves 97 again.

Therefore, when the user wears the shoes of the present invention, by manually operating the operation member 3, the spikes 7 can be freely controlled to protrude out of the shoe plate 9 or retract inwardly to be accommodated in the upright through holes 93, without damaging the floor, thereby allowing the user to go in and out of the room. It is not necessary to change shoes or put on shoe covers. This is quite convenient.

It should be noted that the distance that the moving plates 2 are moved from the first position to the second position is associated with the hole diameter of the track holes 22, and the length of the extension portion of the cam 422 or whether the moving plates 2 are pressed against the surrounding wall 12. The distance that the shoe plate 9 is moved from the retracted position to the extended position is associated with the height of the push member 23. Moreover, the number of the return springs 8 is not limited, so that the shoe plate 9 can be easily moved from the extended position to the retracted position. In this embodiment, the return springs 8 are arranged two by two, such that the shoe plate 9 is balanced under stress.

Figure 7:
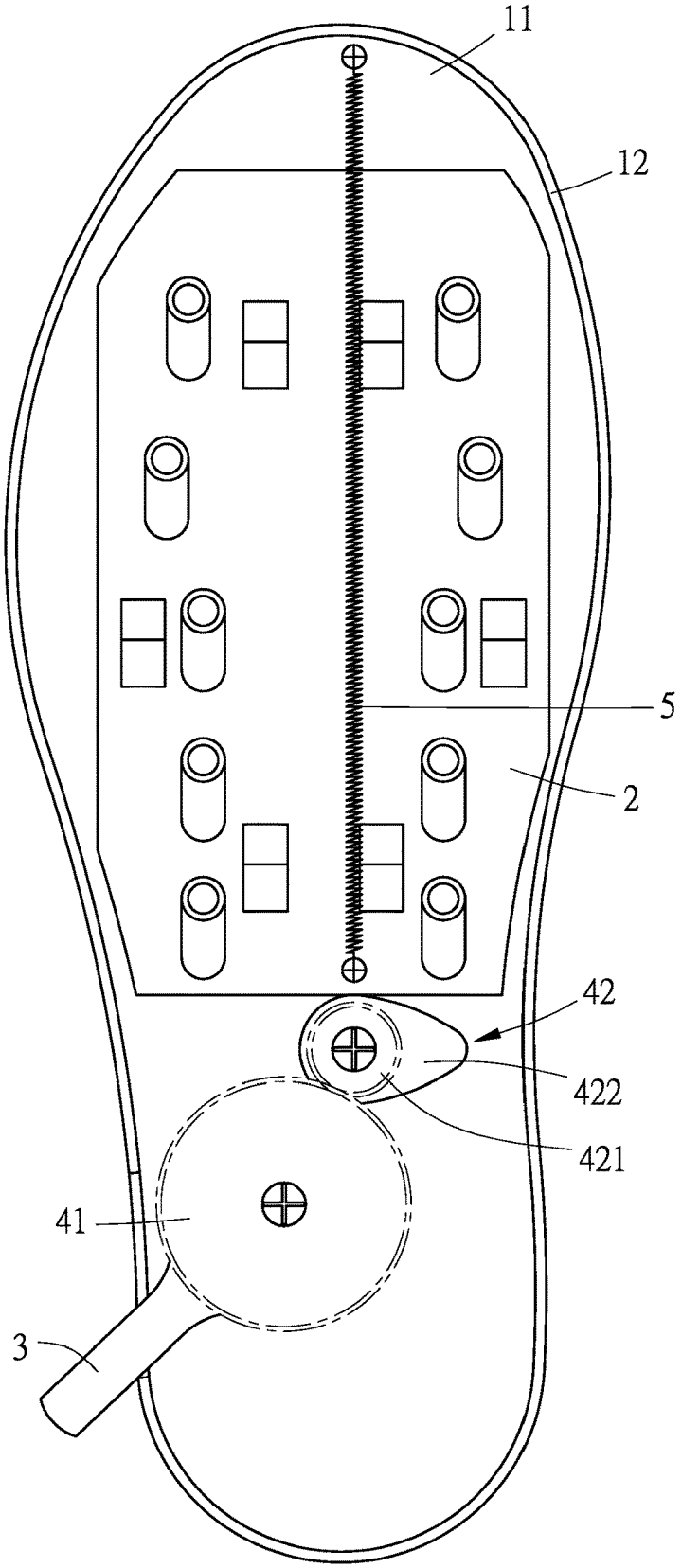
FIG. 7 is a partial top view, illustrating a shoe with spikes in accordance with a second embodiment of the present invention.
Figure 8:
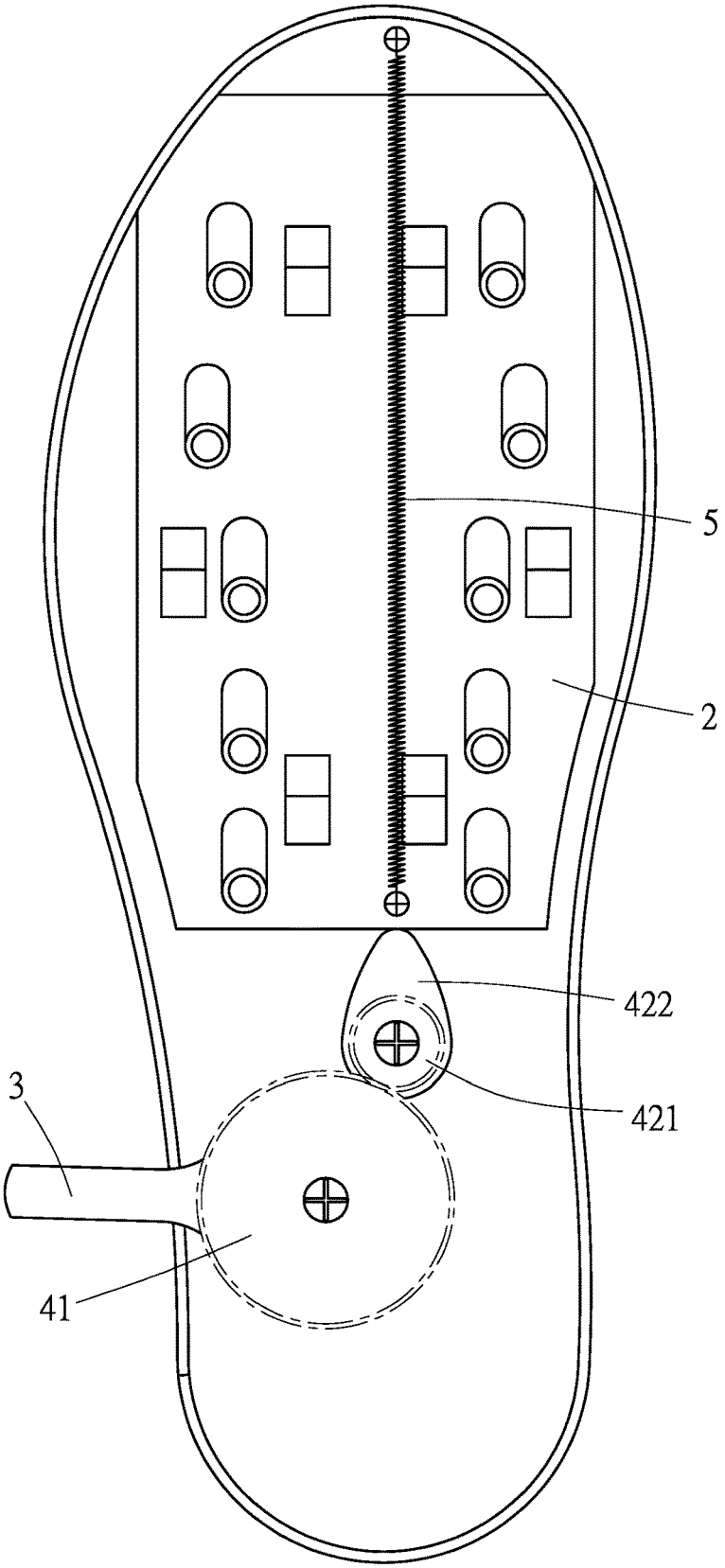
FIG. 8 is a partial top view, illustrating the moving plate located in the second position in accordance with the second embodiment of the present invention.

FIG. 7 and FIG. 8 illustrate a second embodiment of the present invention, which is substantially similar to the first embodiment. The second embodiment includes only one moving plate 2, a moving unit 42 corresponding to the moving plate 2, and a spring 5. One end of the spring 5 is fixed to the moving plate 2 and the other end of the spring 5 is fixed to the bottom wall 11, which also achieves the effect of pushing the shoe plate 9 (FIG. 2). It should be noted that the other end of the spring 5 may be fixed to the surrounding wall 12, as long as the spring 5 can be deformed and generate the horizontal restoring force when the moving plate 2 is moved.

When the operation member 3 is moved from the operation retracted position to the operation extended position, the operation member 3 drives the operation gear 41 to rotate, and the operation gear 41 rotates the control gears 421, and the control gears 421 rotate the cams 422 to push and abut against the moving plate 2, so that the moving plate 2 is moved from the first position to the second position and the spring 5 is deformed. Then, when the operation member 3 is moved to the operation retracted position, the cam 422 is rotated to return to the state that the extension portion of the cam 422 does not abut against the moving plate 2, and the spring 5 generates a horizontal restoring force to move the moving plate 2 back to this first position.

Figure 9:
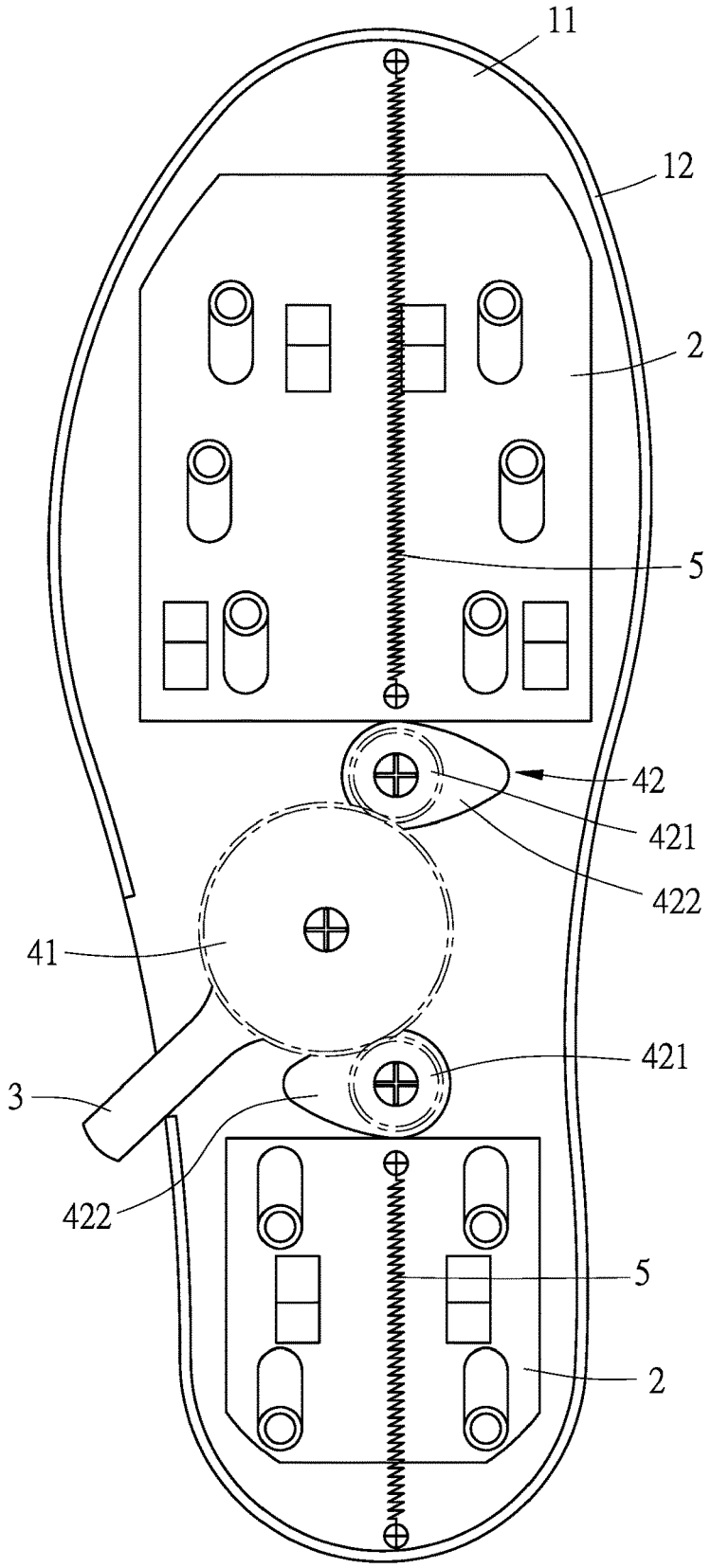
FIG. 9 is a partial top view, illustrating a shoe with spikes in accordance with a third embodiment of the present invention.
Figure 10:
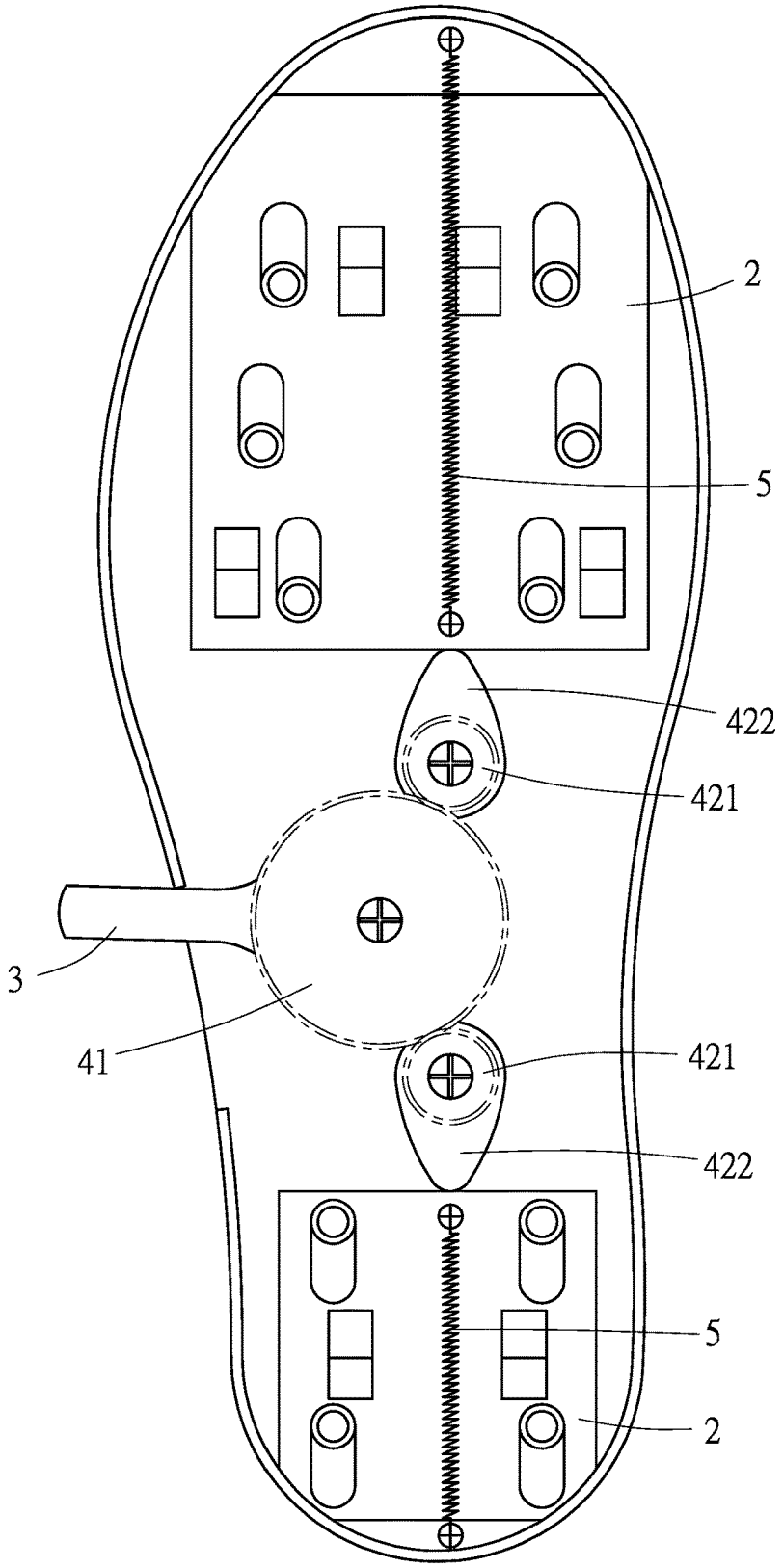
FIG. 10 is a partial top view, illustrating the moving plates located in the second position in accordance with the third embodiment of the present invention.

FIG. 9 and FIG. 10 illustrate a third embodiment of the present invention, which is substantially similar to the second embodiment. The third embodiment includes a plurality of moving plates 2, a plurality of moving units 42 corresponding to the moving plates 2, and a plurality of springs 5 corresponding to the moving plates 2 respectively. One end of each spring 5 is fixed to a corresponding one of the moving plates 2 and the other end is fixed to the bottom wall 11 so as to push the shoe plate 9 (FIG. 2), providing a better effect.

Furthermore, the other ends of the springs 5 may be fixed to the surrounding wall 12 or the other moving plate 2, so that when the moving plates 2 are moved, the springs 5 can be deformed and generate horizontal restoring forces, respectively.

In summary, the present invention enables the at least one moving plate 2 to move horizontally by operating the operation member 3 in cooperation with the transmission module 4 and the at least one spring 5, thereby pushing the shoe plate 9. The vertical restoring forces generated by the return springs 8 enable the shoe plate 9 to move vertically, so that the spikes 7 can protrude out of the shoe plate 9 or retract inwardly to be accommodated in the upright through holes 93, without damaging the floor. The user can freely control the spikes 7 to be exposed or retracted. Therefore, the user does not need to worry about that the spikes 7 may damage the floor. There is no need for the user to change shoes or put on/take off shoe covers, enhancing the convenience of use greatly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shoe, comprising:

a shoe body including a bottom surface relative to the ground;

an accommodation seat including a bottom wall attached to the bottom surface, a surrounding wall extending from the bottom wall toward the ground, and a chamber defined by the bottom wall and the surrounding wall;

at least one moving plate disposed in the chamber and being controlled to move between a first position and a second position, the at least one moving plate including a plurality of push members;

an operation member inserted through the surrounding wall;

a transmission module disposed in the chamber, the transmission module including an operation gear connected with the operation member and at least one moving unit corresponding to the at least one moving plate, the at least one moving unit including a control gear meshing with the operation gear and a cam connected to an axle of the control gear, the cam being rotated to touch and move the at least one moving plate;

at least one spring connected to the at least one moving plate;

a plurality of posts, each post having a first end fixed to the bottom wall and an opposing second end extending toward the ground;

a plurality of spikes respectively fixed to the second ends of the posts and extending out of the chamber;

a shoe plate including a shoe plate body, a push surface formed on the shoe plate body, a plurality of upright through holes formed in the shoe plate body and a plurality of grooves formed on the push surface, the posts being inserted through the upright through holes, respectively, the shoe plate being movably disposed in the accommodation seat;

wherein responsive to the operation member being moved, the operation member drives the operation gear to rotate, and the operation gear rotates the control gear of the at least one moving unit, and the control gear rotates the cam for controlling an extension portion of the cam to either push and lean against the at least one moving plate or remain spaced with respect to the at least one moving plate; wherein responsive to the extension portion of the cam being rotated to lean against the at least one moving plate, the at least one moving plate is secured in one of the first position or the second position and the at least one spring is deformed; wherein responsive to the extension portion of the cam being rotated to remain spaced with respect to the at least one moving plate, the at least one spring generates a horizontal restoring force to move the at least one moving plate to the other of the first position or the second position;

wherein responsive to the at least one moving plate being in the first position, the shoe plate body is in a retracted position and the spikes protrude out of the shoe plate body relative to the ground, and the push members are accommodated in the grooves, respectively; and wherein responsive to the at least one moving plate being moved from the first position to the second position, the push members push the shoe plate body and are moved out of the grooves to lean against the push surface, the shoe plate body is thereby moved toward the ground to an extended position, and the spikes are accommodated in the upright through holes, respectively, and do not protrude out of the shoe plate body relative to the ground; and at least one return spring, the at least one return spring having an inner diameter for insertion of a corresponding one of the posts, the at least one return spring being positioned between the shoe plate body and a corresponding one of the spikes, wherein responsive to the at least one moving plate being moved from the first position to the second position, the shoe plate body is pushed from the retracted position to the extended position to compress the at least one return spring, the at least one return spring being deformed, the at least one return spring being stopped by the corresponding spike to not separate from the corresponding post, and the spikes being accommodated in the upright through holes, respectively; wherein responsive to the at least one moving plate being moved from the second position to the first position, the shoe plate is not pressed and thereby does not compress the at least one return spring, and the at least one return spring generating a vertical restoring force to push the shoe plate body to the retracted position.

2. The shoe as claimed in claim 1, wherein the shoe includes a plurality of moving plates, the spring is connected between any two of the plurality of moving plates, and each of the two of the plurality of moving plates is connected with a corresponding end of the spring.

3. The shoe as claimed in claim 1, wherein the moving plate and the spring are singular, one end of the spring is connected to the moving plate, and another end of the spring is connected to one of the surrounding wall and the bottom wall.

4. The shoe as claimed in claim 1, wherein the shoe includes a plurality of moving plates and a plurality of springs, each moving plate corresponds to a respective one of the plurality of springs, one end of each of the plurality of springs is connected to a corresponding one of the plurality of moving plates, and another end of each of the plurality of springs is connected to one of the surrounding wall and the bottom wall.

5. The shoe as claimed in claim 1, wherein the shoe plate further includes a plurality of first inner peripheral surfaces, a plurality of second inner peripheral surfaces, a plurality of shoulder surfaces connected with the first inner peripheral surfaces and the second inner peripheral surfaces respectively; each of the upright through holes includes a small hole portion surrounded by a corresponding one of the first inner peripheral surfaces and a large hole portion surrounded by a corresponding one of the second inner peripheral surfaces.

6. The shoe as claimed in claim 1, wherein each of the push members has an inclined surface for pushing the shoe plate body from the first position to the second position.

7. The shoe as claimed in claim 1, wherein the moving plate includes a plate body, a plurality of track holes formed in the plate body for insertion of the posts, wherein responsive to the plate body being moved, the track holes are moved relative to the posts, respectively, the posts are thereby kept to be inserted through the track holes, respectively.

8. A shoe, comprising:

a shoe body including a bottom surface relative to the ground;

an accommodation seat including a bottom wall attached to the bottom surface, a surrounding wall extending from the bottom wall toward the ground, and a chamber defined by the bottom wall and the surrounding wall;

at least one moving plate disposed in the chamber and being controlled to move between a first position and a second position, the at least one moving plate including a plurality of push members;

an operation member inserted through the surrounding wall;

a transmission module disposed in the chamber, the transmission module including an operation gear connected with the operation member and at least one moving unit corresponding to the at least one moving plate, the at least one moving unit including a control gear meshing with the operation gear and a cam connected to an axle of the control gear, the cam being rotatable to touch and move the at least one moving plate;

at least one spring connected to the at least one moving plate;

a plurality of posts, each post having a first end fixed to the bottom wall and an opposing second end extending toward the ground;

a plurality of spikes respectively fixed to the second ends of the posts and extending out of the chamber; and a shoe plate including a shoe plate body, a push surface formed on the shoe plate body, a plurality of upright through holes formed in the shoe plate body and a plurality of grooves formed on the push surface, the posts being inserted through the upright through holes, respectively, the shoe plate being movably disposed in the accommodation seat;

wherein responsive to the operation member being moved, the operation gear is driven to rotate by the operation member, and the operation gear rotates the control gear of the at least one moving unit, and the control gear rotates the cam for controlling an extension portion of the cam to either push and lean against the at least one moving plate or remain spaced with respect to the at least one moving plate; wherein responsive to the extension portion of the cam being rotated to lean against the at least one moving plate, the at least one moving plate is secured in one of the first position or the second position and the at least one spring is deformed; wherein responsive to the extension portion of the cam being rotated to remain spaced with respect to the at least one moving plate, the at least one spring generates a horizontal restoring force to move the at least one moving plate to the other of the first position or the second position;

wherein responsive to the at least one moving plate being in the first position, the shoe plate body is in a retracted position and the spikes protrude out of the shoe plate body relative to the ground, and the push members are accommodated in the grooves, respectively;

wherein responsive to the at least one moving plate being moved from the first position to the second position, the push members push the shoe plate body and are moved out of the grooves to lean against the push surface, the shoe plate body is thereby moved toward the ground to an extended position, and the spikes are accommodated in the upright through holes, respectively, and do not protrude out of the shoe plate body relative to the ground; and wherein the moving plate includes a plate body, a plurality of track holes formed in the plate body for insertion of the posts, and responsive to the plate body being moved, the track holes are moved relative to the posts respectively, the posts are thereby kept to be inserted through the track holes, respectively.

* * * * *